United States Patent [19]

Schmidt

[11] 4,262,961

[45] Apr. 21, 1981

[54] CONTAINER LIFT PAD

[75] Inventor: George A. Schmidt, Langhorne, Pa.

[73] Assignee: Strick Corporation, Fort Washington, Pa.

[21] Appl. No.: 1,138

[22] Filed: Jan. 5, 1979

[51] Int. Cl.[3] ..... B62D 21/02; B62D 21/12

[52] U.S. Cl. ..... 296/182; 105/414; 296/204

[58] Field of Search ..... 296/181, 182, 188, 204, 296/209, 29, 30; 105/366 R, 411, 418, 404, 413, 414

[56] References Cited

U.S. PATENT DOCUMENTS

| | | | |
|---|---|---|---|
| 1,149,400 | 8/1915 | Ostrander | 105/414 |
| 2,385,062 | 9/1945 | Ditchfield | 105/418 |
| 2,459,766 | 1/1949 | Black | 296/181 |
| 3,102,498 | 9/1963 | Dean | 105/418 |

*Primary Examiner*—John J. Love
*Assistant Examiner*—Ross Weaver
*Attorney, Agent, or Firm*—Seidel, Gonda, Goldhammer & Panitch

[57] ABSTRACT

A removable L-shaped lift pad for a trailer or cargo container has its legs interconnected by a rub rail. One leg has fastener means to facilitate attachment to traverse beams on a container. The pad provides a flush bottom on a container without welding.

10 Claims, 5 Drawing Figures

FIG. 3
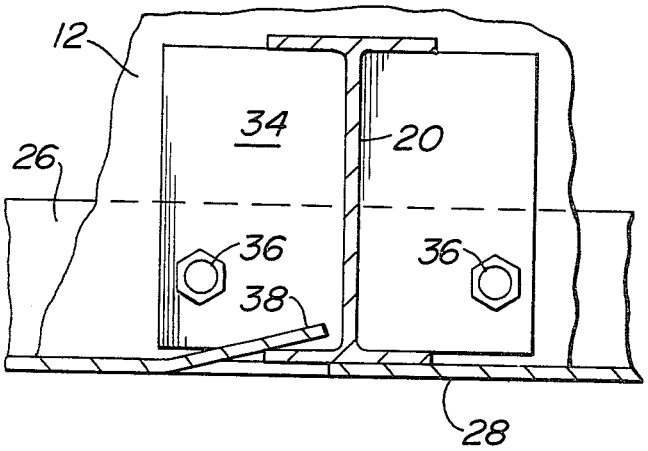
FIG. 5
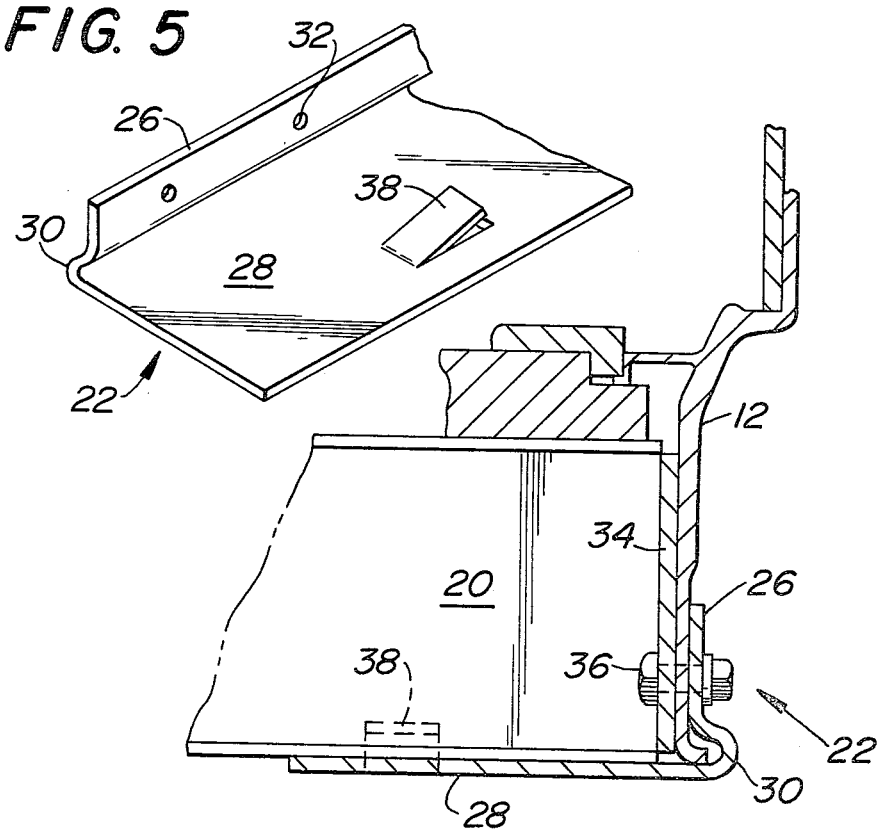
FIG. 4

CONTAINER LIFT PAD

BACKGROUND

To facilitate transfer of containers onto and off of railroad cars, ships and the like, containers are provided with one or more lift pads along the bottom rails thereof. Heretofore, it has been conventional to weld a pad to a transverse beam on the container. Attachment of lift pads in that manner is time consuming and expensive. Once a pad is welded to the container, it is difficult to repair the pad in the event that the pad becomes damaged. The present invention is directed to a solution to this problem.

SUMMARY OF THE INVENTION

The present invention is directed to a container lift pad which is a generally L-shaped metal member having a first leg which is generally vertical disposed and connected to a second leg which is generally horizontally disposed by a rub rail. The first leg is provided with a means to facilitate attachment of the first leg to a container side rail, said second leg having means thereon to facilitate releasable coupling of the second leg to a transverse beam on a container.

It is an object of the present invention to provide a removable lift pad for a trailer or cargo container which provides a flush bottom without requiring welding.

It is another object of the present invention to provide a container lift pad having an integral rub rail with means on the pad to facilitate rapid releasable attachment of the pad to a container in a manner which is simple, inexpensive and reliable.

Other objects will appear hereinafter.

For the purpose of illustrating the invention, there is shown in the drawings a form which is presently preferred; it being understood, however, that this invention is not limited to the precise arrangements and instrumentalities shown.

FIG. 3 is a sectional view taken along the line 3—3 in FIG. 2 but on an enlarged scale.

FIG. 4 is a sectional view taken along the line 4—4 in FIG. 2 but on an enlarged scale.

FIG. 5 is a partial perspective of a rub rail.

Figure 1:
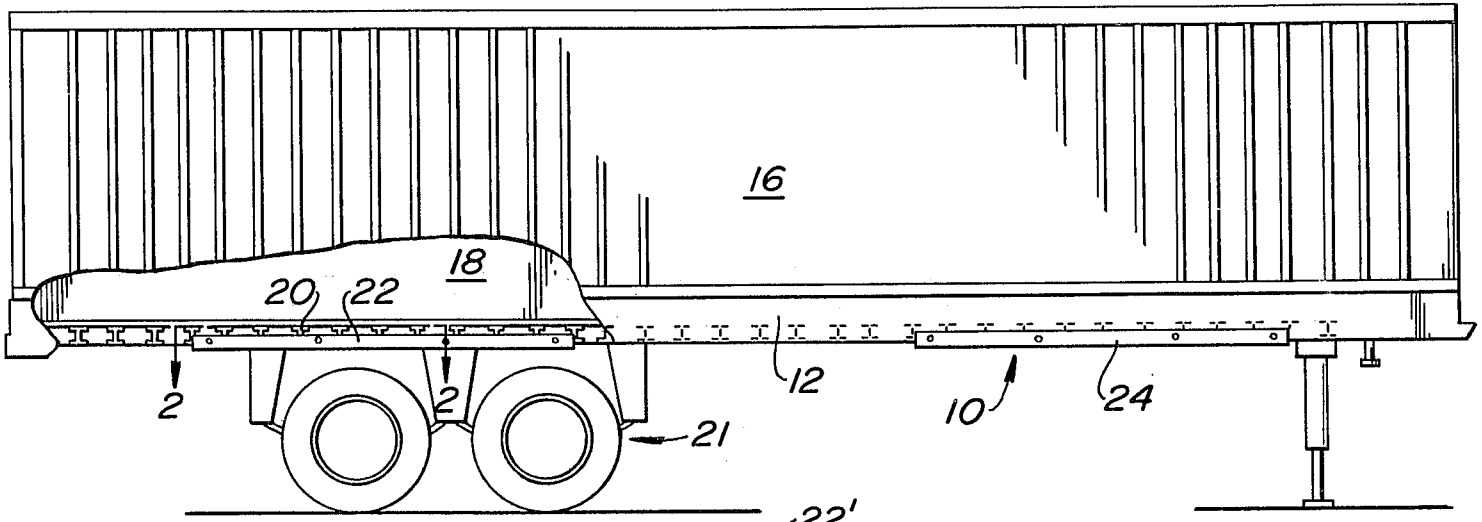
FIG. 1 is a side elevational view of a trailer container incorporating the lift pad of the present invention, and with a portion of the container broken away for purposes of illustration.

Referring to the drawings in detail, wherein like numerals indicate like elements, there is shown in FIG. 1 a container 10. For the purposes of the present disclosure, the container 10 may be considered a conventional trailer container with a side rail 12 supporting a side wall 16 and a side rail 14 supporting a side wall 18. Beams 20 extend transversely between the side rails 12 and 14. Container 10 has running gear designated 21 and has a length of 20 feet or more.

At least one lift pad is attached to the lower edge portion of each of the side rails. As illustrated in the drawing, two discrete lift pads are attached to each side rail of a container whose length is 40 feet. Thus, lift pads 22 and 24 are attached to the side rail 12. A lift pad 22' is attached to the side rail 14 generally opposite the lift pad 22. A lift pad, not shown, is attached to the side rail 14 opposite the lift pad 24.

The lift pads 22, 22' and 24 are all identical. Hence, only lift pad 22 will be described in detail. The lift pads are preferably made from a material such as 7 gauge mild steel structural grade ASTM A36.

Referring to FIGS. 4 and 5, the lift pad 22 includes a vertically disposed leg 26 connected to a horizontally disposed leg 28 by way of a rub rail 30. Leg 28 is substantially wider than the height of the leg 26. Holes 32 are provided in the leg 26 at spaced points therealong.

A mounting plate 34 is welded to the ends of each of the beams 20. Holes are provided in the plate 24 for alignment with two of the holes 32. The lower rail 12 is provided with holes aligned with the holes 32. A discrete fastener 36 extends through each of the sets of aligned holes in plate 34, rail 12 and leg 26. The nut on the fastener 36 does not project beyond the rub rail 30 whereby the nut is not likely to be damaged. The rub rail 30 is preferably curved as shown in FIG. 4.

Figure 2:
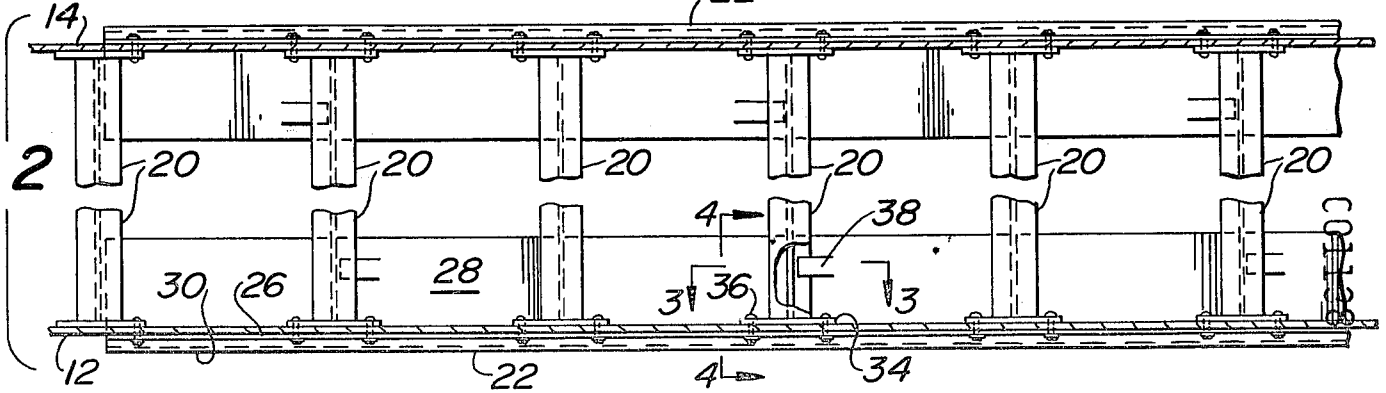
FIG. 2 is a sectional view taken along the line 2—2 in FIG. 1 and on an enlarged scale.

The horizontally disposed leg 28 provides a horizontally disposed flush surface. At spaced points therealong, the leg 28 has tabs 38 struck therefrom and projecting upwardly at a preferred angle of about 12°. Each tab 38 overlies a portion of one of the beams 20. See FIGS. 2 and 3. Leg 28 and its tabs 38 interconnects each of the beams 20 to rigify the same without welding the pad 22 to any portion of the container 10. Leg 28 should have two or more tabs 38. As shown more clearly in FIGS. 3 and 5, the tabs 38 extend in a lengthwise direction on the leg 28.

When installing the pad 22, the holes 32 are misaligned with the holes in the side rail 12 and the associated mounting plate 34. Thereafter, the pad 32 is moved horizontally until each of the tabs 38 overlies a portion of a beam 20. When this occurs, all of the holes of each set will be aligned so that a discrete fastener 36 may be inserted through each set of aligned holes. If the pad 22 or some other portion of the container such as beam 20 becomes damaged, it is readily removable with conventional tools. This is a substantial advantage over the prior art wherein lift pads are welded to the side rail or are otherwise secured whereby removal of damaged elements is difficult, time consuming and expensive. While the nuts attached to each of the fasteners 36 are on the outside of the rails, they may be reversed so as to be on the inside of the rails. In that situation, the rub rail 30 minimizes damage to the heads of the fasteners 36.

The lift pads may be made in a wide variety of dimensions. The preferred dimensions of the lift pads are 10 feet long, leg 28 is 6 inches wide, tab 38 is about 2 inches long, leg 26 including the rub rail 30 is 2½ inches high, rub rail 30 projects outwardly about ½ inch. The lift pad may be extruded in the L-shape shown or may be formed on conventional machinery to the L-shape as shown, and then leg 28 is cut to form tabs 38. While beams 20 are illustrated as being I-beams, the beams may have other shapes such as J, C, L, etc.

The present invention may be embodied in other specific forms without departing from the spirit or essential attributes thereof and, accordingly, reference should be made to the appended claims, rather than to the foregoing specification, as indicating the scope of the invention.

I claim:

1. A container lift pad comprising an elongated generally L-shaped member having first and second legs, said first leg being generally vertical and being connected to said second leg by a rub rail, said second leg being generally horizontal, means on the first leg to facilitate attachment to a trailer container side rail, means on the second leg to facilitate coupling said second leg to each of a plurality of transverse beams on a trailer container, said last mentioned means including a plurality of tabs on said second leg, said tabs being connected to said second leg at one end of the tabs with the other end of the tabs being spaced from and above the elevation of the upper surface of said second leg.

2. A pad in accordance with claim 1 wherein said rub rail is curved through an arc of approximately 180° and projects to one side of the first leg in a direction away from the second leg.

3. A pad in accordance with claim 1 wherein said second leg is substantially wider than the height of said first leg.

4. A pad in accordance with claim 1 wherein said means on the first leg to facilitate attachment to a side rail is a series of holes, said rub rail being curved and projecting to one side of the first leg in a direction away from the second leg, said tabs being integral at one end with the second leg and struck therefrom so as to project upwardly at an acute angle.

5. A container having side walls extending between a floor and a top wall, a lower rail at the bottom end of each side wall, at least one discrete lift pad removably coupled to and shorter than each rail at the lower end thereof, each lift pad being generally L-shaped with a generally vertically disposed first leg juxtaposed to a side face of the associated rail, said first leg being connected to a generally horizontally disposed leg by a rub rail, said horizontally disposed leg being juxtaposed to the bottom surface of a beam extending between said rails, removable means joining the first leg of the pad to said juxtaposed side rail at spaced points therealong, and means removably coupling said horizontally disposed leg at spaced points therealong to each of a plurality of such transverse beams.

6. A container in accordance with claim 5 wherein said coupling means on said horizontally disposed leg includes a plurality of tabs integral at one end with the horizontally disposed leg and struck therefrom, each tab overlying a horizontally disposed portion of a discrete beam at the lower end thereof.

7. A container in accordance with claim 6 wherein said beams are I-beams.

8. A container in accordance with claim 5 including running gear supporting said container and coupled thereto.

9. A container in accordance with claim 6 wherein said tabs extend in a lengthwise direction on the horizontally disposed leg.

10. A container lift pad comprising an elongated generally L-shaped metal member having first and second legs, said first leg being generally vertical and being connected to said second leg by a rub rail, said second leg being generally horizontal, means on the first leg to facilitate attachment to a trailer container side rail, means on said second leg to facilitate coupling said second leg to each of a plurality of transvere beams on a trailer container, and said coupling means including a plurality of tabs integral at one end with the second leg and struck therefrom.

* * * * *